US010312014B2

(12) United States Patent
Lee

(10) Patent No.: US 10,312,014 B2
(45) Date of Patent: Jun. 4, 2019

(54) INDUCTOR WITH IMPROVED INDUCTANCE FOR MINIATURIZATION AND METHOD OF MANUFACTURING THE SAME

(71) Applicant: SAMSUNG ELECTRO-MECHANICS CO., LTD., Suwon-si, Gyeonggi-do (KR)

(72) Inventor: Han Lee, Suwon-si (KR)

(73) Assignee: SAMSUNG ELECTRO-MECHANICS CO., LTD., Suwon-si, Gyeonggi-do (KR)

( * ) Notice: Subject to any disclaimer, the term of this patent is extended or adjusted under 35 U.S.C. 154(b) by 200 days.

(21) Appl. No.: 15/229,359

(22) Filed: Aug. 5, 2016

(65) Prior Publication Data

US 2017/0133146 A1 May 11, 2017

(30) Foreign Application Priority Data

Nov. 9, 2015 (KR) ..... 10-2015-0156432

(51) Int. Cl.
*H01F 27/29* (2006.01)
*H01F 17/00* (2006.01)
*H01F 41/04* (2006.01)

(52) U.S. Cl.
CPC ..... *H01F 27/292* (2013.01); *H01F 17/0013* (2013.01); *H01F 41/042* (2013.01); *H01F 41/046* (2013.01)

(58) Field of Classification Search
USPC ..... 336/192, 200, 232, 83
See application file for complete search history.

(56) References Cited

U.S. PATENT DOCUMENTS

2008/0257488 A1* 10/2008 Yamano ..... H01F 17/0013 156/272.4
2014/0049353 A1 2/2014 Yoon et al.
2015/0009003 A1 1/2015 Ozawa et al.
2016/0126004 A1* 5/2016 Yang ..... H01F 17/0013 336/90
2016/0268038 A1* 9/2016 Choi ..... H01F 41/041
2016/0314890 A1 10/2016 Kitajima et al.

FOREIGN PATENT DOCUMENTS

JP 11-214235 A 8/1999
JP 2002-118022 A 4/2002
JP 2015-15297 A 1/2015
KR 10-2014-0023141 A 2/2014
WO 2015115180 A1 8/2015

OTHER PUBLICATIONS

Office Action issued in Japanese Patent Application No. 2016-155421 dated Jun. 6, 2017, with English language translation.

* cited by examiner

*Primary Examiner* — Elvin G Enad
*Assistant Examiner* — Kazi S Hossain
(74) *Attorney, Agent, or Firm* — Morgan Lewis & Bockius LLP

(57) ABSTRACT

An inductor includes: a body having a coil including lead out portions disposed therein, and external electrodes connected to the lead out portions, at least partially disposed in the body, and exposed to a first surface of the body, thereby miniaturizing an inductor, securing Q characteristics, and improving inductance.

8 Claims, 6 Drawing Sheets

INDUCTOR WITH IMPROVED INDUCTANCE FOR MINIATURIZATION AND METHOD OF MANUFACTURING THE SAME

CROSS-REFERENCE TO RELATED APPLICATION

This application claims the benefit to priority of Korean Patent Application No. 10-2015-0156432 filed on Nov. 9, 2015, with the Korean Intellectual Property Office, the disclosure of which is incorporated herein by reference.

BACKGROUND

The present disclosure relates to an inductor and a method of manufacturing the same.

A multilayer inductor may have a structure in which a plurality of insulating layers having conductor patterns formed thereon are stacked, in which the conductor patterns may be sequentially connected by conductive vias formed on each of the insulating layers and may overlap each other in a stacking direction to form a coil having a spiral structure. Further, both end portions of the coil may be drawn out to an external surface of a laminate to be connected to an external terminal.

Inductors are mainly surface mount device (SMD) type inductors mounted on circuit boards. High frequency inductors may be used at high frequencies of 100 MHz or above, and the use of high frequency inductors in the communications market is gradually increasing. The most important feature in high frequency inductors is securing quality factor Q characteristics representing efficiency of a chip inductor. In this case, Q=wL/R, in which the Q value is a ratio of inductance L and resistance R in a given frequency band.

A large number of components need to be mounted on a circuit board in a limited area, and therefore demand for the miniaturization of components is increasing. To secure the same degree of capacity while miniaturizing the inductor, there is a need to reduce a thickness or a line width of a coil pattern. In this case, Q characteristics may be reduced and the use frequency may be narrowed.

Therefore, there is a need to develop an inductor structure capable of securing inductance capacity and Q characteristics while miniaturizing the inductor.

SUMMARY

An external electrode may be formed on the external surface of a body, and therefore there may be a limitation in the miniaturization of the inductor.

An exemplary embodiment in the present disclosure may allow a size of an inductor to be reduced, secure Q characteristics and improve inductance by forming an external electrode on a body.

According to an exemplary embodiment in the present disclosure, an inductor may include: a body including a first surface and a second surface, a third surface and a fourth surface connecting the first surface and the second surface, and a coil disposed therein, the coil including first and second lead out portions extended toward the first surface; external electrodes disposed in the body, including a first external electrode connected to the first lead out portions and exposed to the first surface and the third surface of the body, and a second external electrode connected to the second lead out portions and exposed to the first surface and the fourth surface of the body, thereby allowing an inductor to be miniaturized, Q characteristics to be secured, and inductance to be improved.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Figure 1:
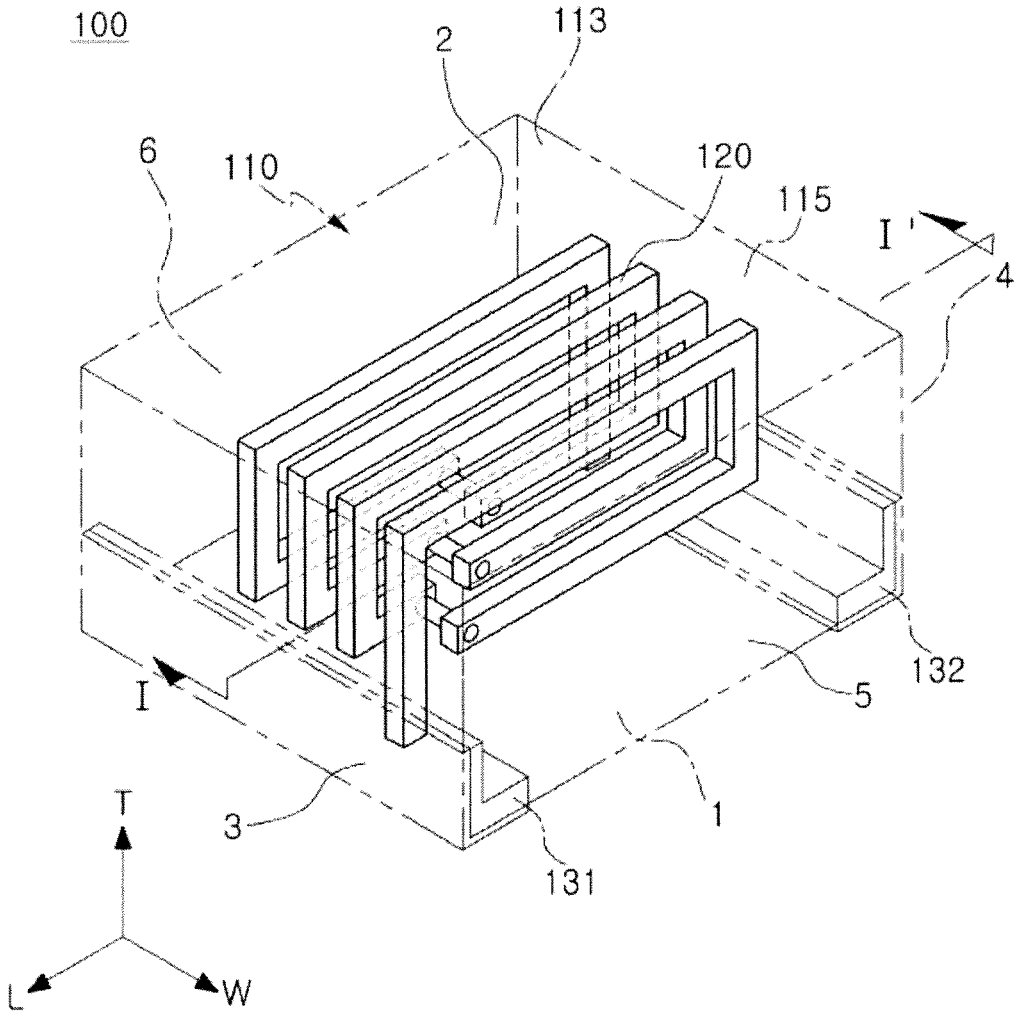
FIG. 1 is a perspective view schematically illustrating an inductor according to an exemplary embodiment in the present disclosure.

Hereinafter, embodiments of the present disclosure will be described as follows with reference to the attached drawings.

The present disclosure may, however, be exemplified in many different forms and should not be construed as being limited to the specific embodiments set forth herein. Rather, these embodiments are provided so that this disclosure will be thorough and complete, and will fully convey the scope of the disclosure to those skilled in the art.

Throughout the specification, it will be understood that when an element, such as a layer, region, or wafer (substrate), is referred to as being "on," "connected to," or "coupled to" another element, it can be directly "on," "connected to," or "coupled to" the other element or other elements intervening therebetween may be present. In contrast, when an element is referred to as being "directly on," "directly connected to," or "directly coupled to" another element, there may be no elements or layers intervening therebetween. Like numerals refer to like elements throughout. As used herein, the term "and/or" includes any and all combinations of one or more of the associated listed items.

It will be apparent that though the terms first, second, third, etc. may be used herein to describe various members, components, regions, layers, and/or sections, these members, components, regions, layers, and/or sections should not be limited by these terms. These terms are only used to distinguish one member, component, region, layer, or section from another region, layer, or section. Thus, a first member, component, region, layer, or section discussed below could be termed a second member, component, region, layer, or section without departing from the teachings of the exemplary embodiments.

Spatially relative terms, such as "above," "upper," "below," and "lower" and the like, may be used herein for ease of description to describe one element's relationship to another element(s) as shown in the figures. It will be understood that the spatially relative terms are intended to encompass different orientations of the device in use or operation in addition to the orientation depicted in the figures. For example, if the device in the figures is turned over, elements described as "above" other elements, or "upper," would then be oriented "below" the other elements or features, or "lower." Thus, the term "above" can encompass both the above and below orientations depending on a particular direction of the figures. The device may be otherwise oriented (rotated 90 degrees or at other orientations) and the spatially relative descriptors used herein may be interpreted accordingly.

The terminology used herein is for describing particular embodiments only and is not intended to be limiting of the present disclosure.

Hereinafter, embodiments of the present disclosure will be described with reference to schematic views illustrating embodiments of the present disclosure. In the drawings, for example, due to manufacturing techniques and/or tolerances, modifications of the shape shown may be estimated. Thus, embodiments of the present disclosure should not be construed as being limited to the particular shapes of regions shown herein, for example, to include a change in shape results in manufacturing. The following embodiments may also be constituted by one or a combination thereof.

The contents of the present disclosure described below may have a variety of configurations and propose only a required configuration herein, but are not limited thereto.

Hereinafter, an inductor 100 according to the present disclosure will be described.

Figure 2:
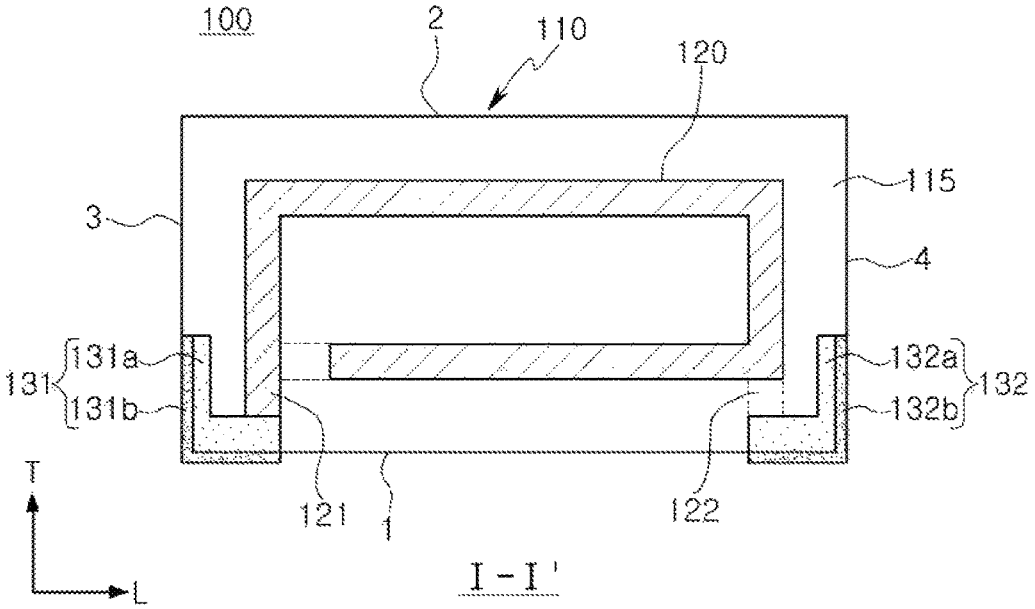
FIGS. 2 and 3 are a cross-sectional view schematically illustrating the inductor according to an exemplary embodiment in the present disclosure.
Figure 3:
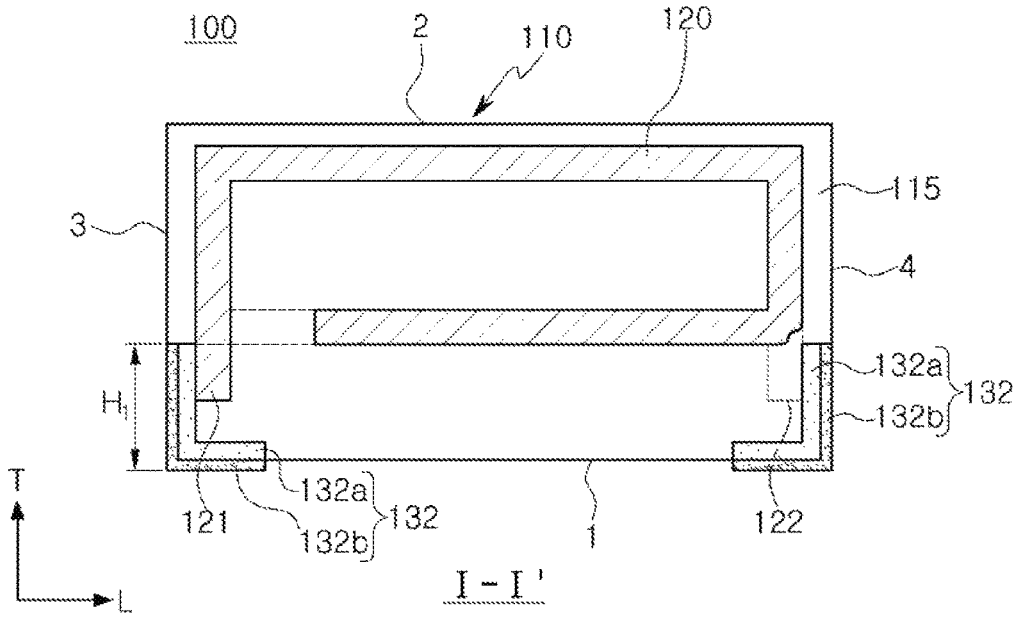

FIG. 1 is a perspective view schematically illustrating an inductor according to an exemplary embodiment in the present disclosure and FIGS. 2 and 3 are a cross-sectional view schematically illustrating the inductor according to an exemplary embodiment in the present disclosure.

Referring to FIGS. 1 to 3, an inductor according to an exemplary embodiment in the present disclosure may include a body 110 including a first and second surfaces 1 and 2, and third and fourth surfaces 3 and 4 connecting the first and second surfaces 1 and 2, and having a coil 120 disposed therein. The coil 120 includes a first lead out portion 121 (shown in foreground) and a second lead out portion 122 (shown in background) that extend toward the first surface 1. External electrodes 131 and 132 are disposed in the body 110 and include a first external electrode 131 connected to the first lead out portion 121 and exposed to the first and third surfaces 1 and 3 of the body, and a second external electrode 132 connected to the second lead out portion 121 and exposed to the first and fourth surfaces 1 and 4 of the body.

The body 110 includes first and second surfaces 1 and 2 opposing each other in the thickness direction, third and fourth surfaces 3 and 4 opposing each other in the length direction, and fifth and sixth surfaces 5 and 6 opposing each other in the width direction. The insulating layers may be stacked in the width direction.

The body 110 may be formed by stacking the insulating layer, in which the insulating layer may include a magnetic material such as ferrite or a ceramic.

The insulating layers may be integrated so that boundaries between individual insulating layers after the firing may not be able to be confirmed without the use of a scanning electron microscope. A shape and dimensions of the body 110 and the number of stacked insulating layers are not limited to those of the exemplary embodiment in the present disclosure.

An interior of the body 110 may be provided with the coil.

The coil 120 may contain a conductive metal.

The coil 120 may be formed of a material containing silver (Ag) or copper (Cu) or alloys thereof, but is not limited thereto.

The coil 120 may include the first and second lead out portions 121 and 122 extended toward the first surface of the body. That is, the first and second lead out portions may extend toward the same surface.

The first and second lead out portions may respectively contact and be electrically connected to the first and second external electrodes 131 and 132 formed at the first surface 1 of the body 110.

The coil 120 may comprise a plurality of coil patterns connected through conductive vias (not shown) and may be wound.

At least one of an upper portion and a lower portion of the body 110 may be provided with a cover layer 113 to protect the coil in the body 110.

The cover layer 113 may be formed by printing a paste formed of the same material as the insulating layer at a predetermined thickness.

Existing inductors may have external electrodes formed on one or more external surfaces of the body. The size of the inductor may thus include the external electrode, making it difficult to miniature the inductor. Furthermore, a volume around the external electrode protruding from the body does not contribute to inductance, and therefore there may be a problem in that an amount of capacitance corresponding to the size of the inductor may not be secured.

The inductor 100 according to the exemplary embodiment in the present disclosure may include the external electrodes 131 and 132, including the first external electrode 131 formed in the body 110 and exposed to the first and third surfaces 1 and 3 of the body and the second external electrode 132 exposed to the first and fourth surfaces 1 and 4 of the body, thereby improving inductance as compared to the same size of existing inductors, implementing the miniaturization of the inductor, and securing the Q characteristics.

The external electrodes 131 and 132 may have an "L" shape.

Referring to FIG. 3, a height of the portion of the external electrodes 131 and 132 respectively exposed to the third surface 3 and the fourth surface 4 of the body may be the same as a height (H1) of the lead out portion of the coil 120. As a result, an empty space may be formed between the coil positioned in the body and the external electrode to reduce permittivity of the body, thereby implementing the inductor in a high frequency region.

The external electrodes 131 and 132 may respectively be formed in the directions of the third surface and the fourth surface in the body 110 to be spaced apart from the coil 120.

The first and second external electrodes 131 and 132 may respectively include conductive layers 131*a* and 132*a* and plating layers 131*b* and 132*b* formed on a surface of conductive layers.

The conductive layers 131*a* and 132*a* may be formed of a conductive metal material having excellent electrical conductivity.

The conductive metal material may include at least one of silver (Ag) and copper (Cu) or alloys thereof but is not limited thereto.

The plating layers 131*b* and 132*b* may be formed of nickel (Ni) or tin (Sn) but are not limited thereto.

In the conductive layers 131*a* and 132*a*, the portion formed in the direction of the first surface 1 of the body may extend to have an outer surface aligned with the first surface 1 of the body.

In the plating layers 131*b* and 132*b*, the respective portions formed in the directions of the third and fourth surfaces 3 and 4 of the body may extend to have their respective outer surfaces respectively aligned with the third and fourth surfaces 3 and 4 of the body.

The external electrodes 131 and 132 may be formed by penetrating the insulating layer 111 in the body 110 through a surface perpendicular to the stacking direction. The surface perpendicular to the stacking direction may be the first surface 1, the second surface 2, the third surface 3, and/or the fourth surface 4 of the body, and the external electrode may be formed to penetrate through some of the first surface 1, the third surface 3, and the fourth surface 4 of the body.

Therefore, in the inductor according to the present disclosure, the external electrode may be disposed, at least partially, in the body to increase an internal area of the coil, thereby improving the inductance.

TABLE 1

| Frequency | Inventive Inductor, Inductance (H) | Existing Inductor, Inductance (H) |
|---|---|---|
| 100 MHz | 3.8159 | 3.5347 |
| 500 MHz | 3.6735 | 3.4202 |
| 900 MHz | 3.6886 | 3.4346 |

Table 1 presents measured inductances at different frequencies for an inductor according to the exemplary embodiment in the present disclosure and for an existing inductor with external electrodes formed on the external surface of the body. The inductors were manufactured at the same size of 0603 (0.6*0.3*0.4 mm: L*W*T).

Referring to the above Table 1, it may be appreciated that, for this example, the inductor according to the exemplary embodiment in the present disclosure shows an improved inductance of as much as 7 to 8% compared to the existing inductor.

That is, the inductive capacity can be increased when the inductor includes the external electrode disposed, at least partially, in the body in comparison to an existing inductor with external electrodes formed on the external surface of the body.

Hereinafter, a method of manufacturing an inductor according to the present disclosure will be described.

FIGS. 4A through 4D are a schematic process plan and cross-sectional views illustrating a method of manufacturing an inductor according to an exemplary embodiment in the present disclosure.

The method of manufacturing an inductor according to the exemplary embodiment in the present disclosure may include: forming an insulating layer 111 (not shown); forming coil patterns 120*a* and 120*b* on the insulating layer 111, forming conductive patterns 131*a* and 132*a* in an opening of the insulating layer; forming a laminate (not shown) by stacking a plurality of the insulating layers on which the coil patterns 120*a* and 120*b* and the conductive patterns 131*a* and 132*a* are formed; and cutting and firing the laminate (not shown) to form a body 110 including a first electrode.

Figure 4A:
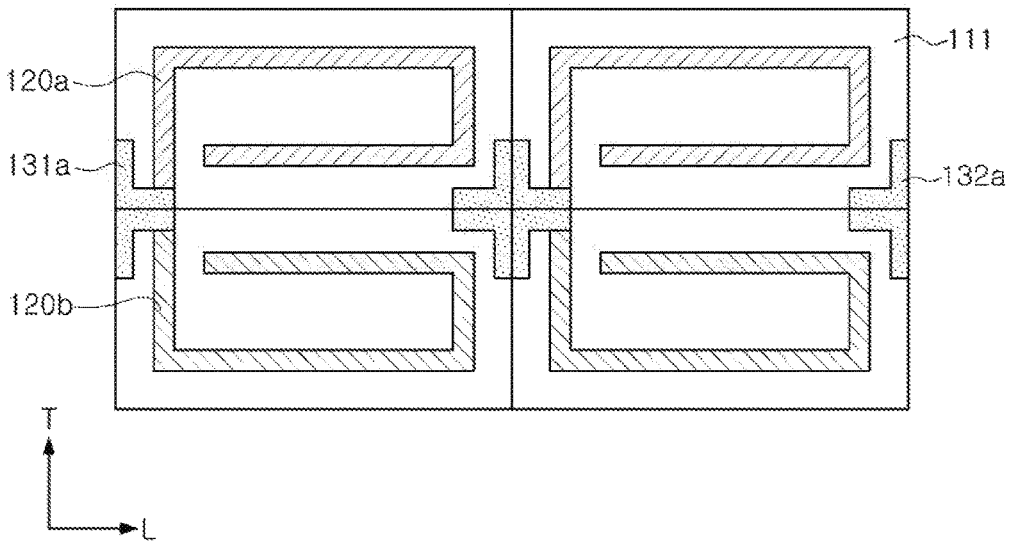
FIGS. 4A through 4D are plan and cross-sectional views schematically illustrating a method of manufacturing an inductor according to an exemplary embodiment in the present disclosure.

Referring to FIG. 4A, the coil patterns 120*a* and 120*b* may be formed on the insulating layer 111 and the conductive patterns 131*a* and 132*a* may be formed in the opening.

The insulating layer 111 may be formed of a magnetic material such as ferrite.

The insulating layer 111 may be manufactured by mixing and dispersing the magnetic material and organic matters to manufacture slurry and then molding the slurry.

The coil patterns 120*a* and 120*b* may be formed by printing a conductive paste including conductive metal on the insulating layer.

The coil patterns 120*a* and 120*b* may use a material having excellent electric conductivity and may include conductive metal such as silver (Ag) or copper (Cu) or alloys thereof, but are not limited thereto.

The total stacked number of insulating layers 111 formed may be variously determined in consideration of electrical characteristics such as an inductance value required in the designed inductor component.

The total stacked number of insulating layers includes coil patterns without lead out portions (not shown) to be stacked in between coil pattern 120*a* and coil pattern 120*b*.

Via electrodes (not shown) may be disposed in the insulating layers 111 to electrically connect conductive patterns of adjacent insulating layers.

The via electrodes connect the vertically disposed coil patterns, including conductive coil pattern 120*a*, the conductive coil patterns without lead out portions, and conductive coil pattern 120*b*, to thereby form the coil.

The via electrodes may be formed by forming a through hole in each of the insulating layers 111 in a location within the area where the conductive pattern will be formed, and then filling the through hole when forming the conductive pattern by printing the conductive paste on the insulating layer.

The conductive paste may be formed of at least one of silver (Ag), silver-palladium (Ag—Pd), nickel (Ni), and copper (Cu) or alloys thereof, but is not limited thereto.

The conductive patterns 131*a* and 132*a* may be formed by printing a conductive paste including conductive metal on the opening of the insulating layer.

The conductive patterns 131*a* and 132*a* are to form the external electrodes and may include the conductive metal. The conductive pattern may be formed by being printed in an "L" shape.

The conductive metal may be formed of a material including at least one of silver (Ag) and copper (Cu) or alloys thereof, but is not limited thereto.

The conductive patterns 131*a* and 132*a* may be formed to be spaced apart from the coil patterns without lead out portions upon the printing.

Figure 4B:
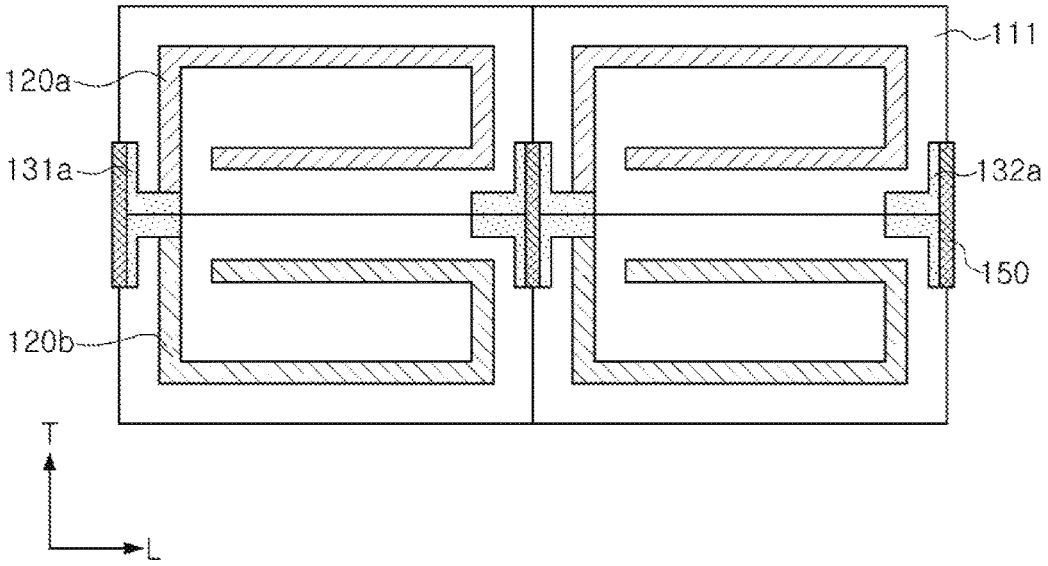

Referring to FIG. 4B, a portion 150 of the conductive pattern formed on the insulating layer 111 may be removed.

The portion 150 of the conductive pattern may be a portion formed on a surface that will become the third or fourth surfaces 3 or 4 of the body.

The portion 150 of the conductive pattern may be removed by at least one of punching, laser etching, and etching processes.

By removing the portion 150 of the conductive pattern, a space in which the plating layer of the external electrodes is formed may be prepared within the region of the insulating layer.

Figure 4C:
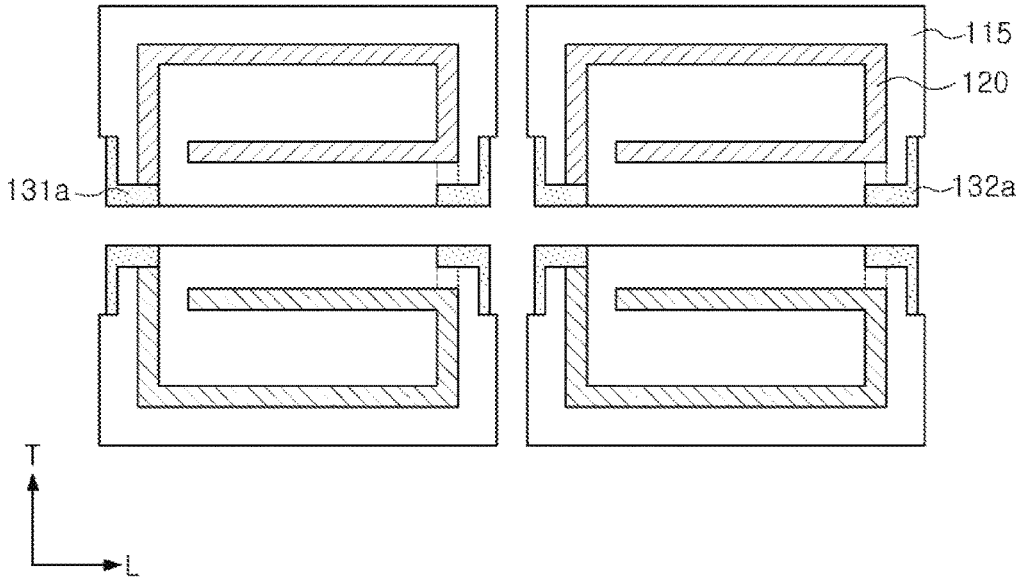

Referring to FIG. 4C, the insulating layers may be cut for stacking and firing to form the body 120 including the conductive layers 131*a* and 132*a* of the external electrodes.

Next, the body 110 may be pressed and hardened so that a filling rate of the body 110 may be maximum in methods such as pressing and vacuum pressing.

The body may be cut into individual chip units and thus a plurality of bodies 110 may be manufactured. As a result, the manufacturing costs of the inductor may be reduced and a high rate of productivity may be secured.

In the forming of the body, when the coil pattern is silver (Ag), it may be sintered under the general atmosphere and when the coil pattern is copper (Cu), may be performed under the reduction atmosphere.

Figure 4D:
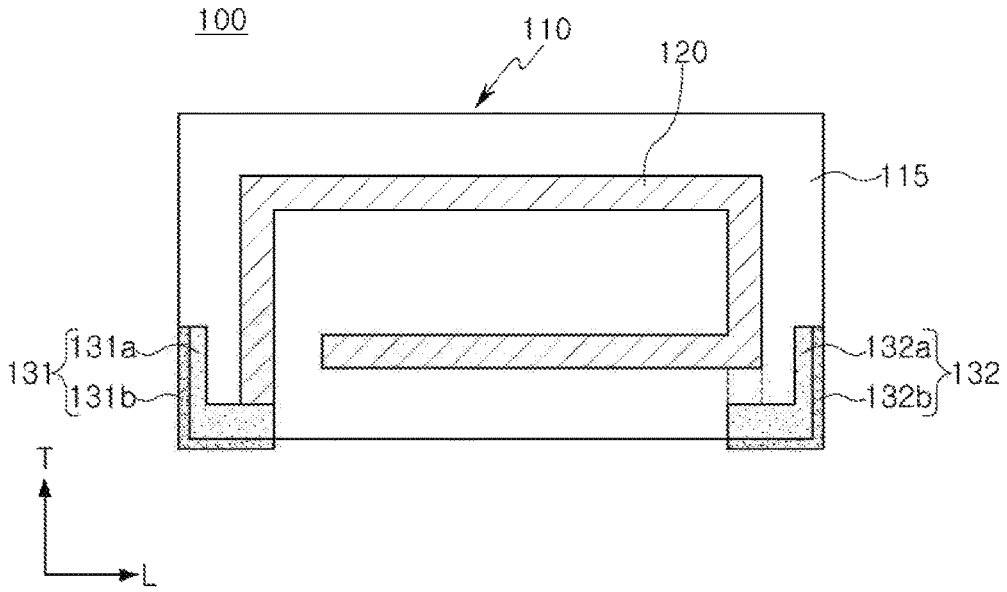

Referring to FIG. 4D, the plating layers 131*b* and 132*b* of the external electrodes may be formed on the conductive layers 131*a* and 132*a* of the external electrodes.

The plating layers 131*b* and 132*b* may be formed by plating nickel (Ni) or tin (Sn).

The external electrodes 131 and 132 including the first electrode and the second electrode may be disposed at least partially in the body 110 to secure the Q characteristics and increasing the area of the interior of the coil, thereby obtaining the improved inductance at the same size.

As set forth above, according to one exemplary embodiment of the present disclosure, the inductor may secure the Q characteristics and improve the inductance.

While exemplary embodiments have been shown and described above, it will be apparent to those skilled in the art that modifications and variations could be made without departing from the spirit and scope of the present disclosure as defined by the appended claims.

What is claimed is:

1. An inductor, comprising:

a body including a coil disposed therein, the coil including first and second lead out portions extended toward a first surface opposing a second surface and connecting a third surface to a fourth surface; and external electrodes, disposed at least partially in the body, including a first external electrode connected to the first lead out portion and exposed to the first and third surfaces of the body, and a second external electrode connected to the second lead out portion and exposed to the first and fourth surfaces of the body, wherein each of the external electrodes include a conductive layer and a plating layer formed on a surface of the conductive layer, wherein a portion of the respective plating layers of the external electrodes in the directions of the third and fourth surfaces of the body, respectively, have an outer surface aligned with the third and fourth surfaces of the body, respectively.

2. The inductor of claim 1, wherein the external electrodes have an L shape.

3. The inductor of claim 1, wherein a portion of the respective conductive layers of the external electrodes in the direction of the first surface of the body have an outer surface aligned with the first surface of the body.

4. The inductor of claim 1, wherein the external electrodes are spaced apart from the coil.

5. The inductor of claim 1, wherein the first surface is perpendicular to a direction in which the coil is wound.

6. A multilayer inductor, comprising:

a body including a plurality of stacked insulating layers having conductor patterns formed thereon; and first and second external electrodes disposed at least partially in the body and exposed to a first surface of the body, wherein at least one of the conductor patterns includes a first lead out portion connected to the first external electrode and at least one of the conductor patterns includes a second lead out portion connected to the second external electrode, wherein the first and second external electrodes each include a conductive layer and a plating layer formed on a surface of the conductive layer, wherein a portion of the respective plating layers of the first and second external electrodes in the directions of second and third surfaces of the body, respectively, have an outer surface aligned with the second and third surfaces of the body, respectively.

7. The multilayer inductor of claim 6, wherein the body further includes a cover layer in at least one of the upper or lower portion of the body in the stacking direction.

8. The multilayer inductor of claim 6, wherein a portion of the conductive layers of the first and second external electrodes are aligned with the first surface of the body and a portion of the plating layers at the first surface are external to the body.

* * * * *